US006679767B2

(12) United States Patent
Löhnert

(10) Patent No.: US 6,679,767 B2
(45) Date of Patent: Jan. 20, 2004

(54) DEVICE FOR PROCESSING A KNIFE-EDGE

(75) Inventor: Horst Löhnert, Ostfildern (DE)

(73) Assignee: Friedr. Dick GmbH, Deizisau (DE)

( * ) Notice: Subject to any disclaimer, the term of this patent is extended or adjusted under 35 U.S.C. 154(b) by 0 days.

(21) Appl. No.: 10/206,229

(22) Filed: Jul. 29, 2002

(65) Prior Publication Data

US 2003/0077991 A1 Apr. 24, 2003

(30) Foreign Application Priority Data

Oct. 20, 2001 (DE) ..... 101 51 961

(51) Int. Cl.[7] ..... B24B 3/36
(52) U.S. Cl. ..... 451/319; 451/486; 451/540
(58) Field of Search ..... 451/319, 321, 451/349, 480, 484, 486, 552–556, 558, 45; 76/82, 86, 88

(56) References Cited

U.S. PATENT DOCUMENTS 1,041,631 A * 10/1912 Johnson ..... 451/486
4,934,110 A * 6/1990 Juranitch ..... 451/486
5,040,435 A * 8/1991 Millman ..... 76/86
5,440,953 A * 8/1995 Gangelhoff et al. ..... 76/86
5,478,272 A * 12/1995 Cozzini et al. ..... 451/540
5,655,959 A * 8/1997 Juranitch ..... 451/486

* cited by examiner

*Primary Examiner*—Joseph J. Hail, III
*Assistant Examiner*—David B. Thomas
(74) *Attorney, Agent, or Firm*—Paul Vincent

(57) ABSTRACT

The invention concerns a device for sharpening or polishing the blade of a knife, having a slit 2 which is provided in a base plate 1 and which is open towards the outside, for guiding the knife blade, and with processing rods 3, 3' which are pivotably disposed on each side of the slit 2 in opposition to an elastically resilient restoring force and which intersect in the region of the slit 2, wherein the knife blade can be applied to their point of intersection 16. Each processing rod 3, 3' is rigidly connected at its pivot axis 7 to the axis of an eccentric disc 8, 8' which is radially loaded by a spring element 13, 13', such that when the point of intersection 16 is in the region of the outer end of the slit 2 (original position), the spring element 13, 13' engages a location of the eccentric disc 8, 8' whose radial separation from the eccentric axis 7, 7' is smaller than the radial separation of the location where the spring element 3, 3' engages when the point of intersection 16 is in the region of the inner end of the slit 2. Alternatively, an elastically resilient arm is connected to the pivot pin 7 of a processing rod 3, 3' for secure mutual rotation therewith, whose free end is supported on a stop 19, 20, 21 of the base plate 1.

27 Claims, 6 Drawing Sheets

DEVICE FOR PROCESSING A KNIFE-EDGE

This application claims Paris Convention priority of DE 101 51 961.3 filed Oct. 20, 2001 the complete disclosure of which is hereby incorporated by reference.

BACKGROUND OF THE INVENTION

The invention concerns a device for processing (sharpening and polishing) a knife-edge comprising a slit which is provided in a base plate and is open to the outside, for guiding the knife-edge, and processing rods which are pivotably disposed in opposition to an elastically resilient restoring force on each side of the slit and which intersect in the region of the slit, wherein the knife-edge can be applied at their point of intersection.

In a known device of this type (U.S. Pat. No. 4,934,110), the restoring force for the processing rods is produced by a helical spring whose one end is mounted to the base plate and whose other end engages at the end of an arm of a two-armed lever whose other arm is rigidly mounted to a processing rod and is pivotably disposed about a bolt mounted in the base plate. In this known device, the axial deflection of the helical spring is relatively large when the point of intersection of the processing rods travels along the slit in the base plate from the outside to the inside. Consequently, the forces acting on the knife-edge at the point of intersection substantially depend on the spring characteristics and can therefore change over time in an undesirable manner. To obtain as flat a spring response as possible, a relatively long helical spring is required and therefore a large base plate. This makes the device cumbersome. Attempts have been made to keep the angle at which the processing rods abut the knife-edge during motion along the slit approximately constant through corresponding curvature of the processing rods. It has, however, not been possible to completely eliminate the influence of the spring characteristic response on the forces acting on the knife-edge at the point of intersection. U.S. Pat. No. 4,934,110 also discloses a device with which the restoring force acting on the processing rods is not generated by a spring, rather by weights. This device is heavy and can only be used in orientations in which the weights are moved by gravity.

It is the underlying purpose of the invention to develop a device which is as light and handy as possible with which the forces acting on the knife-edge remain as constant as possible during movement of the point of intersection.

SUMMARY OF THE INVENTION

This object is achieved in accordance with the invention in that each processing rod is rigidly connected at its pivot axis to the axis of an eccentric disc having a weight which is less than or equal to that of the processing rod(s) and on which a spring element, which produces a radial spring force on the eccentric disc, engages such that with the point of intersection being in the region of the outer end of the slit (original position) the spring element engages a location of the eccentric disc whose radial separation from the eccentric axis is smaller than the separation radius of the location where the spring element engages the eccentric disc when the point of intersection is in the region of the inner end of the slit.

Through the use of an eccentric disc in the load path between the pivot axis of the processing rods and the spring element, the deflection of the spring element can be as small as desired through selection of the eccentricity of the eccentric disc. This eccentricity must be sufficiently large that the spring element engaging on the eccentric disc produces a restoring force which pivots the processing rods back into their original position when the knife-edge is removed from the slit. The eccentric discs can be light discs, which, in and of themselves cannot reset the processing rods. The invention facilitates construction of a light and handy device, which the user can attach to his/her apron.

In embodiments of the invention, the spring element can engage the periphery of the eccentric disc or on an arc-shaped contact surface disposed inward of that periphery. In the latter case, this contact surface extending inward of the periphery of the eccentric disc can be the bottom of a groove, which is recessed in the periphery of an eccentric disc. In this embodiment of the invention, the sides of the groove prevent the spring element from sliding off the contact surface. This contact surface can also be provided as a rib on the eccentric disc, wherein the spring element is guided on one side. In embodiments of the invention, the eccentric disc can be shaped to form a shoulder in the region of the contact surface for the spring element such that this shoulder forms the contact surface and one side of the spring element is once more secured with respect to sliding off the contact surface by the side surface of the eccentric disc. This embodiment of the invention may be further developed in that a further disc is mounted to the side surface of the eccentric disc to guide the spring element on the side facing away from the eccentric disc.

In embodiments of the invention, the spring element can have different designs. In one embodiment of the invention, the periphery of a cylindrical helical spring, which is mounted at both ends to the base plate, abuts the eccentric disc tangentially, optionally under pressure. The helical spring is laterally deflected by the eccentricity of the eccentric disc against the spring force of the helical spring, with this deflection producing the restoring force which returns the processing rods into the original position when the knife-edge is removed from the device slit. The point of larger eccentricity of the eccentric disc can thereby slide along the periphery of the helical spring during lateral deflection of that spring. Use of a helical spring having tight, optimally pretensioned windings which abut each other is thereby advantageous.

In another embodiment of the invention, the spring element is a leaf spring whose one end can be rigidly connected to the base plate and with its free end cooperating with the eccentric disc to either seat on the periphery of the eccentric disc or on a surface recessed from that periphery.

In a further embodiment of the invention, a spring wire is used as spring element, which seats on the eccentric disc to constitute the above-mentioned helical spring.

In all of the above-mentioned embodiments of the spring element, the maximum spring element deflection is given by the degree of eccentricity of the eccentric disc during motion of the processing rods, and not by the degree of angular rotation and therefore not by the degree of pivoting motion of the processing rods. The overall device can therefore be relatively small.

The object of the invention can also be achieved by an inventive embodiment wherein each processing rod is rigidly connected at its pivot axis to a hub from the periphery of which an elastically resilient arm projects in a radial direction whose free end abuts a stop in the base plate. This arm acts like a leaf spring. When the point of intersection of the processing rods is in the vicinity of the inner end of the slit, this resilient arm is tensioned to a greater extent than in the original position of the processing rods and pivots the processing rods back into their original position when the knife-edge is removed from the slit.

This embodiment of the invention can be further developed in that the elastically resilient arm is integral with the hub and the arm and hub consist of plastic material forming a plastic injection-molded part, which is inexpensive to produce.

In embodiments of the invention, the spring element can be mounted to the base plate in a replaceable or removable fashion to facilitate cleaning of the device and of the spring element.

The device advantages of low weight and simplicity of production can be further improved by the following features.

The base plate can be produced as a molded component using plastic or light metal. Stops which are known per se can be injection-molded to the base plate for the pivoting motion of the processing rods. In embodiments of the invention, fastening means for the spring element can be injection-molded to the base plate to form e.g. bolts for mounting a helical spring or the like. The base plate can be inexpensively produced as an injection-molded part, also taking into consideration ergonomic points of view.

Finally, handling of the device is facilitated when the base plate has an opening, which can serve as a handle for accepting fingers of a hand. The pivot bearings for the processing rods (such as openings in the hubs, within which the processing rods are mounted) can already be provided in the base plate during injection-molding thereof.

Finally, the use of the inventive device is further facilitated when at least one recess is provided in the base plate for mounting the device to a base. In embodiments of the invention, this can be e.g. a recess (preferably a dovetailed recess) at the edge of the base plate with which the device can be pushed onto a corresponding holding part of a support.

The processing rods can be mounted to a hub passing through the base plate, an end of which bears the eccentric disc for secure mutual rotation therewith. This mounting can be realized in embodiments of the invention in that the hub has at least one radial opening through which an end of the processing rod can be guided. This ensures secure mutual rotation between the processing rod and, via the hub, the eccentric disc.

The processing rods can be connected to the hub in a replaceable fashion so that processing rods for polishing or sharpening the knife-edge can be connected to the hub, in dependence on the requirements. Processing rods can also be connected to the hub (acting as a pivoting bolt) which comprise a section for polishing the knife-edge and a section for sharpening the knife-edge (as is known per se).

Further features of the invention can be extracted from the following description of embodiments of the invention in connection with the claims and the drawing. The individual features can be realized in embodiments of the invention either individually or collectively in any arbitrary combination.

The drawing shows portions of two embodiments which are required for understanding of the invention.

DESCRIPTION OF THE PREFERRED EMBODIMENT

Figure 1:
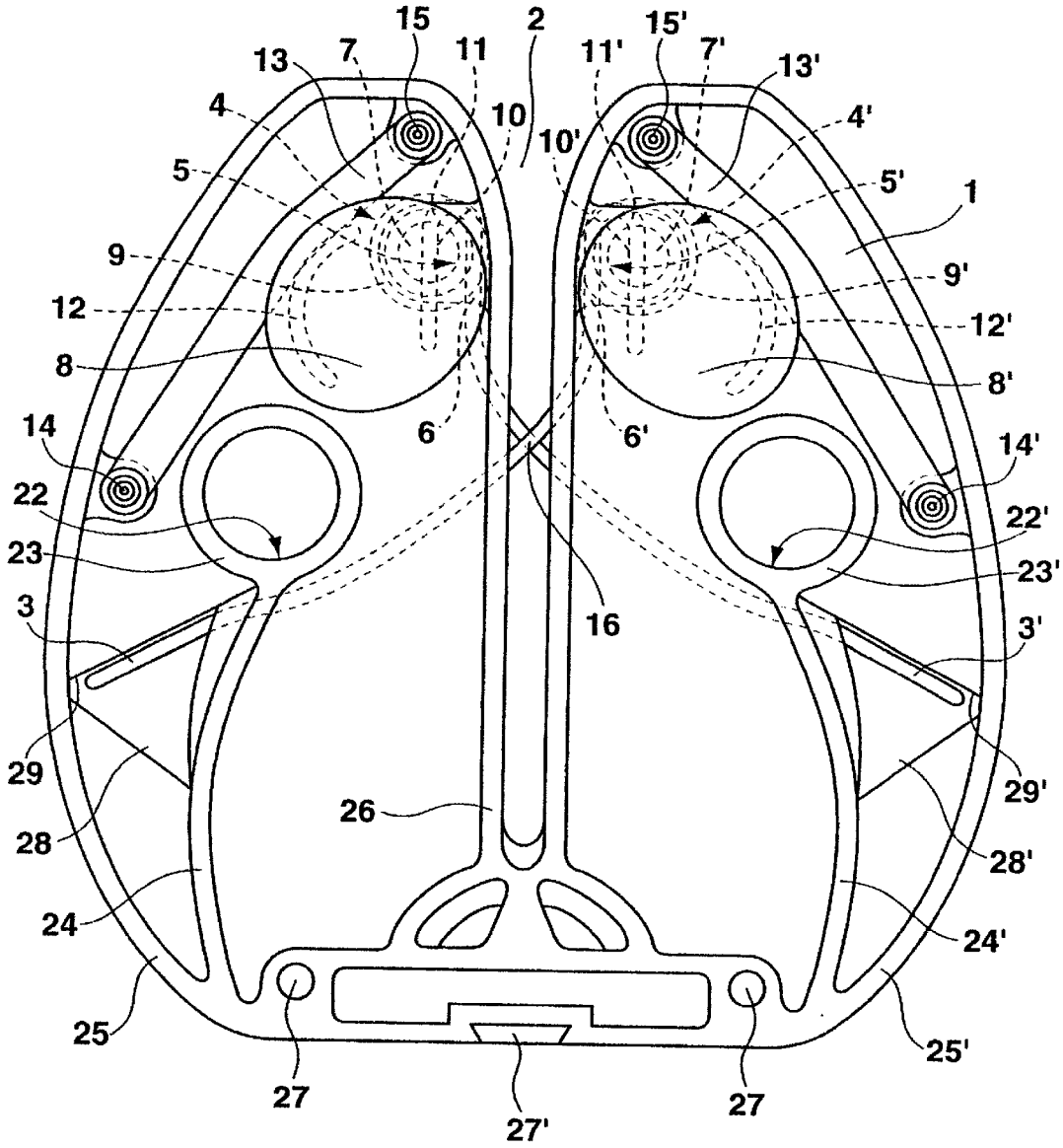
FIG. 1 shows a rear view of the device with the processing rods in their original position.
Figure 1A:
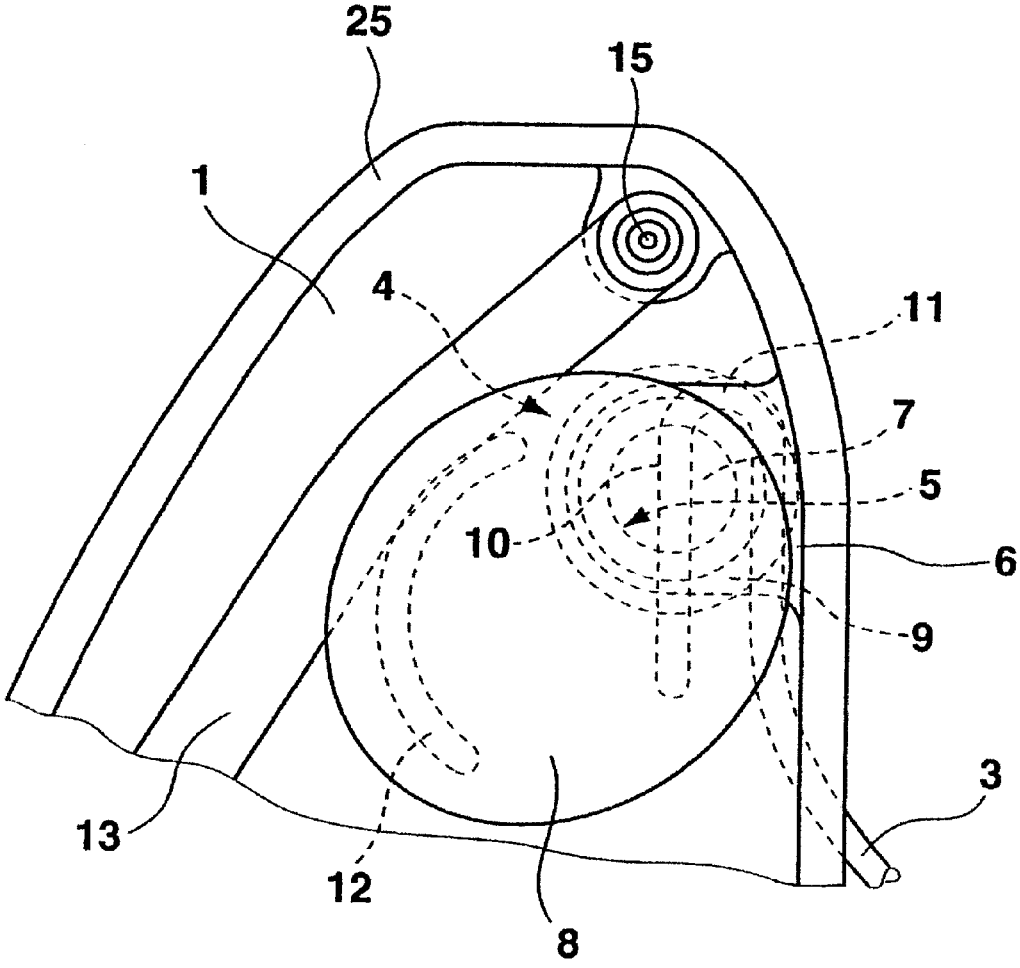
FIG. 1*a* shows an enlarged section of FIG. 1.
Figure 2:
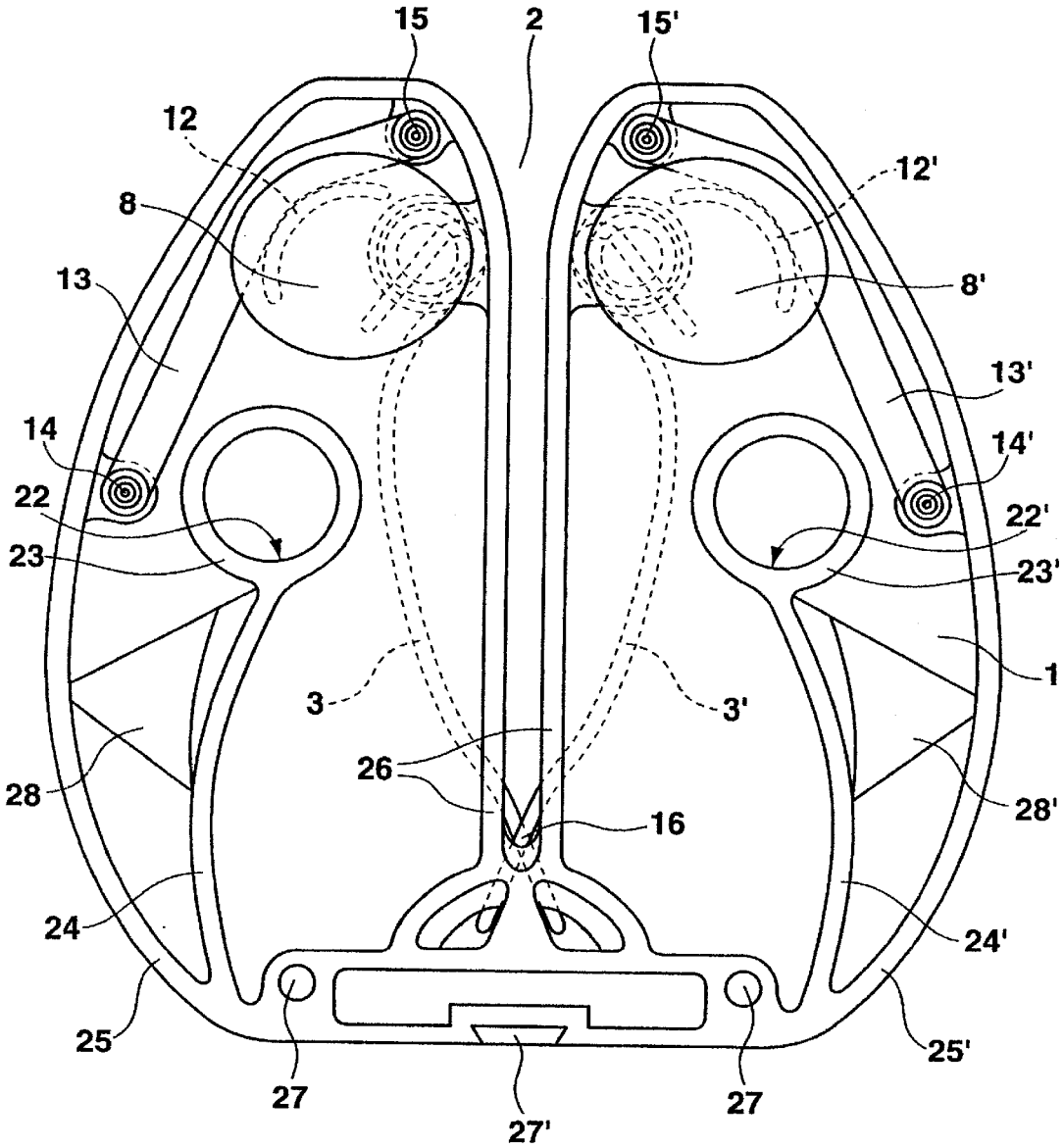
FIG. 2 shows the view of the device of FIG. 1 wherein the point of intersection of the two processing rods is located in the region of the inner end of a slit for guiding the blade of a knife.

In the embodiment of the invention shown in FIGS. 1 and 2, a base plate 1 has a slit 2 which is open towards the outside into which a knife blade is inserted from the top to the bottom (in the drawing) to be sharpened or polished. Processing rods 3, 3' are pivotably disposed on the rear (in the view shown) side of the base plate 1 in pivot bolt hubs 4, 4' seating in openings 5, 5' of the base plate 1 defined by shackles 6, 6' provided for reinforcing the walls of the openings. The hubs 4, 4' have a pivot pin 7, 7' which passes through the opening 5, 5' and on which an eccentric disc 8, 8' (disposed on the rear side in the drawing) is mounted in an eccentric and secure fashion. The hubs 4, 4' have a groove 9, 9' along their periphery into which the (in the drawing) upper end of the processing rods 3, 3' is inserted. The hubs thereby have at least one radial through-bore 10, 10' through which the U-shaped bent ends of the processing rods 3, 3' are inserted to be connected to the hub 4, 4' for secure mutual rotation therewith. The U-shaped bend 11, 11' of the upper end of the processing rods 3, 3' can be designed such that the section of the processing rods 3, 3' adjacent said bend 11, 11' is clamped to securely seat in the groove 9. The bend 11, 11' can also be designed such that the processing rods 3, 3' in FIG. 1 can be pushed upwards and out of the bores 10, 10' and be separately cleaned or replaced.

The eccentric disc 8 is mounted on the pivot pin 7, 7' at a separation from the base plate 1. A rib 12 is mounted, preferably injection-molded, to the inner side of the eccentric disc 8, 8' facing the base plate 1, which extends parallel to and inside of the periphery of the eccentric disc 8, 8' to form a curved seating surface for a spring element 13, 13'. In the embodiment of FIG. 1, this spring element 13, 13' comprises a cylindrical helical spring 13, 13' which is attached at each end to a retaining bolt 14, 14' and 15, 15', mounted in the base plate 1. In the original position of the processing rods 3, 3' shown in FIG. 1, the spring element 13, 13' is supported under tension at a location of the rib 12 which only slightly pushes the otherwise straight-line extension of the cylindrical helical spring 13, 13' towards the outside. The point of intersection 16 of the two processing rods 3, 3' is still in the vicinity of the upper outer end of the slit 2 (original position). When a knife-edge is introduced into the slit 2, the processing rods 3, 3' are pivoted such that the point of intersection 16 comes to rest in the region of the lower end of the slit 2 (FIG. 2). The eccentric disc 8, 8' is thereby pivoted about its pivot pin 7, 7' to such an extent that the spring element 13, 13' comes to rest on a section of the rib 12 whose radial separation from the pivot pin 7, 7' is larger than the radial separation of the contact point on the rib in the original position of FIG. 1 having upper point of intersection 16. In the position shown in FIG. 2, the rib 12 forces the spring element 13, 13' much further towards the outside than in the original position (FIG. 1). The spring element 13, 13' of FIG. 2 urges the eccentric disc 8, 8' back into the original position (FIG. 1) such that the processing rods 3, 3' are pivoted back into the original position (FIG. 1) with upper point of intersection 16.

Figure 3:
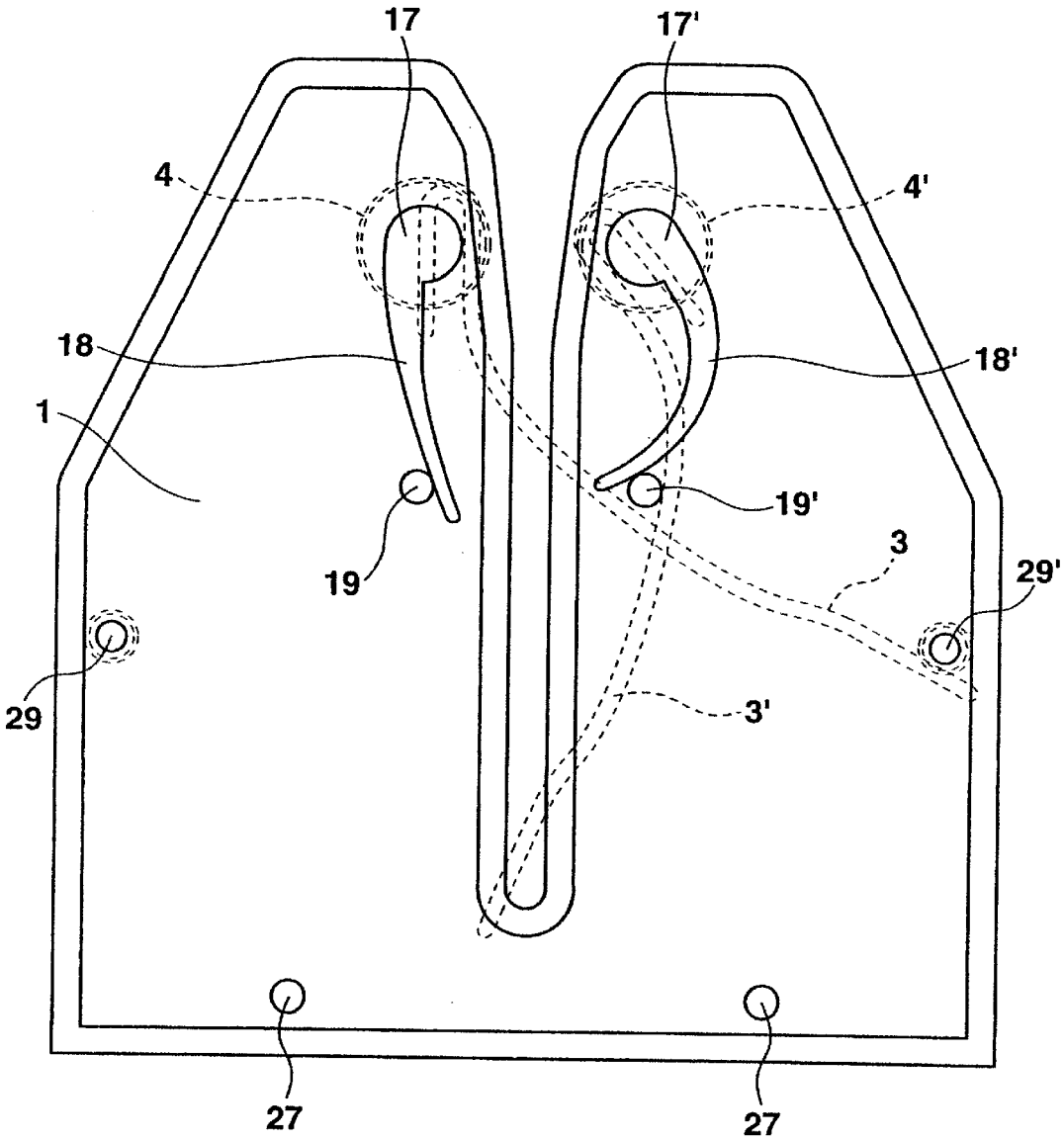
FIG. 3 shows an embodiment of the device from the rear side without eccentric disc with an elastic arm as spring element; the side left of center of the illustration shows the original position and the side right of center shows the final position of a processing rod.
Figure 4:
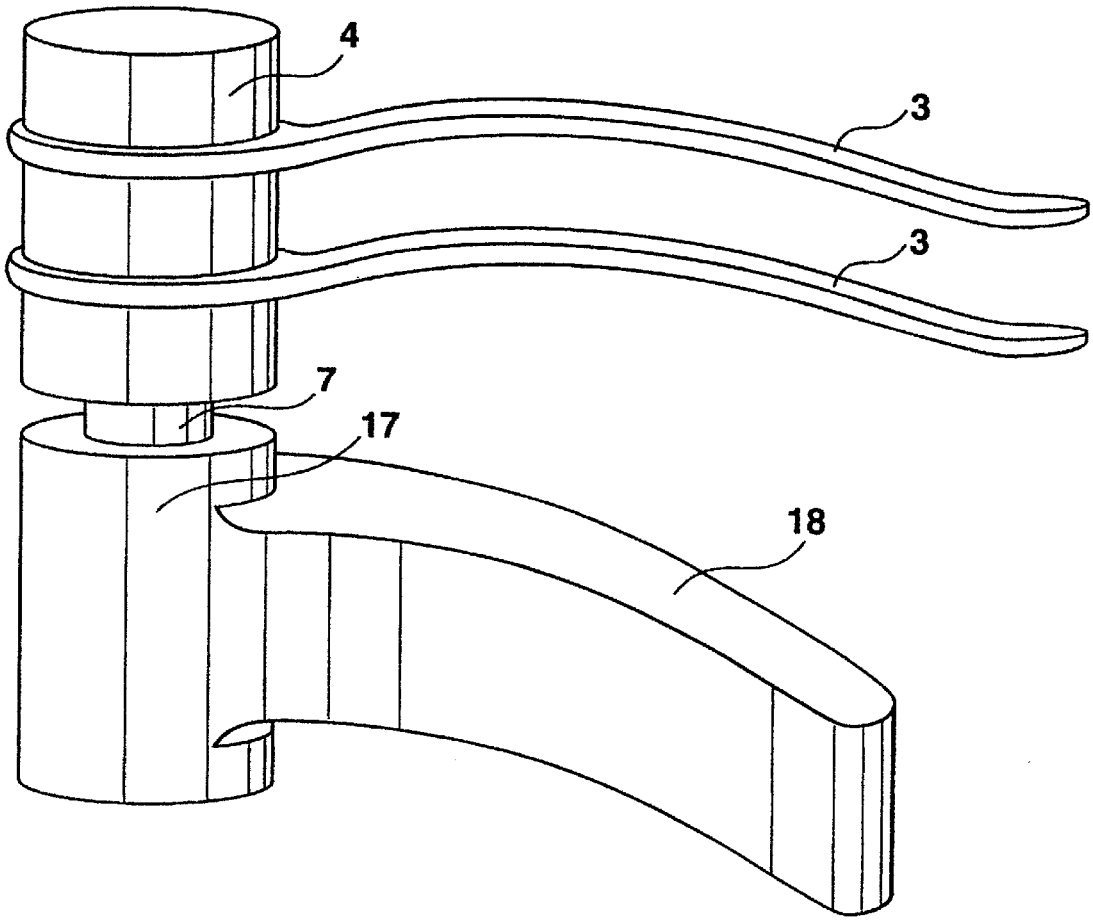
FIG. 4 shows the spring element used in the embodiment of FIG. 3 and the hub for two processing rods connected therewith.
Figure 5:
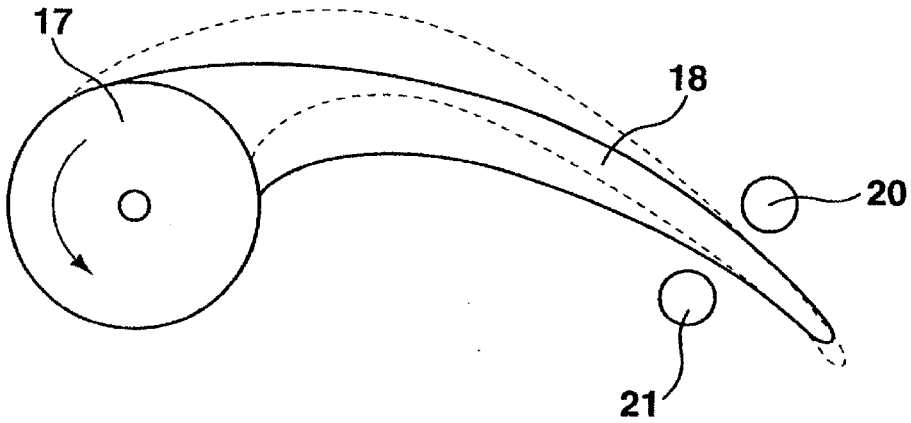
FIG. 5 shows a top view of the movement of the elastic arm shown in FIG. 4.

In the embodiment of the invention shown in FIGS. 3 to 5, a second hub 17, 17' is connected to the hub 4, 4' or its pivot pin 7, 7' for secure mutual rotation therewith to replace the eccentric disc 8, 8' and the helical spring 13, 13' engaging thereon. An elastically resilient arm 18, 18' projects from the periphery of the hub 17, 17'. The free end of this arm 18, 18' can be resiliently supported on only one single stop pin 19 (FIG. 3) or can engage between two pins 20 and 21 (FIG. 5) which are disposed in the base plate 1 similar to the stop pin 19. The hub 17, 17' and the arm 18, 18' can be injection-molded from plastic as a single piece. FIG. 3 shows that the arm 18, 18', which functions as a leaf spring, is only slightly tensioned in the original position of the processing rods 3, 3' (in FIG. 5 in the extended state) but considerably more tensioned (bent) in the end position of the processing rods 3, 3' (shown as dashed lines in FIG. 5). The torsionally secure connection between the hub 17, 17' and the hub 4, 4' may be detachable such that the device parts disposed on the front side of the base plate 1 and those disposed on the rear side of the base plate 1 can also be removed from the device for cleaning or replacement in this embodiment of the invention.

The embodiment of the invention shown in FIGS. 3 to 5 has the advantage that its construction is particularly simple.

In the embodiment of FIG. 4, two parallel processing rods 3 are disposed at a separation from each other on one side of the slit 2. One or two processing rods 3' are provided on the other side of the slit 2 and engage between the processing rods 3. The processing rods 3, 3' of the embodiment shown in FIGS. 3 to 5 are mounted in the hubs 4, 4' in the same way as in the embodiment of FIGS. 1 and 2.

Figure 6:
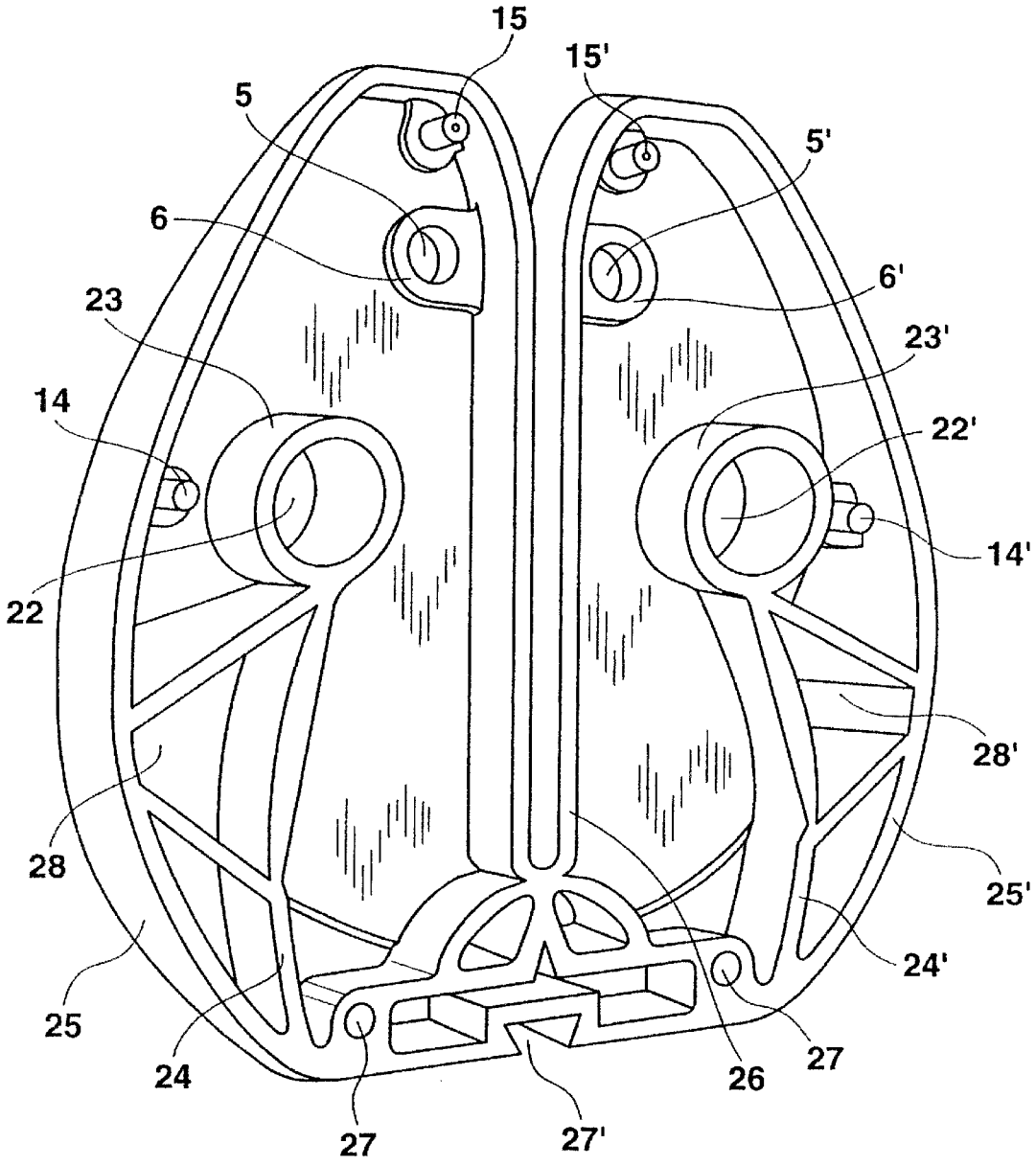
FIG. 6 shows a perspective rear view of a base plate designed as injection-molded part.

The base plate 1 which can be made from plastic material or light metal has openings 22, 22' for handling the device by inserting the fingers of a hand. The walls of the openings 22, 22' are reinforced by sleeve sections 23, 23' which are additionally held by a rib 24, 24' which leads to the edge of the base plate 1 and is connected there to a further rib 25, 25' which, for its part, extends along the edge of the base plate 1 and projects upwardly therefrom in a rim-like manner (FIGS. 1, 2 and 6). The edges of the slit 2 are also protected and reinforced by ribs 26 projecting from the base plate. The lower end of the base plate (FIGS. 1, 2 and 6) has a dovetailed recess 27' which can serve for mounting e.g. pushing the device onto a corresponding retaining part of a support.

Further openings 28, 28' in the base plate 1 (FIGS. 1, 2 and 6) reduce the weight of the device and permit insertion of the fingers of a hand for holding the device. In embodiments of the invention, stops 29, 29' (FIG. 3) for the processing rods 3, 3' can be provided in the original position in the base plate 1 such that this original position is always defined.

The invention concerns a device for sharpening or polishing a knife blade with a slit 2 provided in the base plate 1 which is open towards the outside and in which the knife blade can be guided, and with processing rods 3, 3' which are pivotably disposed on each side of the slit 2 in opposition to an elastically resilient restoring force and which intersect in the region of the slit 2, wherein the knife blade can be applied to the point of intersection 16. Each processing rod 3, 3' is securely connected at its pivot axis 7 to the axis of an eccentric disc 8, 8' which is radially loaded by a spring element 13, 13' such that when the point of intersection 16 is in the region of the outer end of the slit 2 (original position), the spring element 13, 13' engages a location of the eccentric disc 8, 8' whose radial separation from the eccentric axis 7, 7' is smaller than the radial separation of the spring element 3, 3' engagement location when the point of intersection 16 is in the region of the inner end of the slit 2. Alternatively, an elastically resilient arm is connected to the pivot pin 7 of a processing rod 3, 3' for secure mutual rotation therewith, whose free end is supported on a stop 19, 20, 21 of the base plate 1.

I claim:

1. A device for processing the blade of a knife, the device comprising:

a base plate having a slit dimensioned for guiding the blade, said slit having an opening proximate an outer portion of said base plate for introduction of the blade;

a first processing rod having first a pivot axis cooperating with said base plate at a first side of said slits;

a second processing rod having a second pivot axis cooperating with said base plate at a second side of said slit opposite said first side;

a first eccentric disc cooperating with said first pivot axis;

a second eccentric disc cooperating with said second pivot axis;

a first spring element mounted to said base plate for radially loading said first eccentric disc; and a second spring element mounted to said base plate for radially loading said second eccentric disc, wherein said first and said second processing rods are loaded by elastic resilient forces of said first and second spring elements to urge said rods towards said slit opening, said first and second processing rods intersecting in a region of said slit at a point of intersection to which the blade can be applied, wherein, when said point of intersection first accepts the blade, said first and said second spring elements engage said first and said second eccentric discs at first radial separations from said first and said second pivot axes and when said point of intersection approaches an inner end region of said slit, said first and said second spring elements engage said first and said second eccentric discs at second radial separations from said first and said second pivot axis, said second radial separations being larger than said first radial separations.

2. The device of claim 1, wherein said first and said second eccentric discs have disc weights and wherein said first and said second processing rods have rod weights greater than or equal to said disc weights.

3. The device of claim 1, wherein said first spring element seats on a periphery of said first eccentric disc.

4. The device of claim 1, wherein said first eccentric disc has an arc-shaped contact surface for said first spring element, disposed radially within its periphery.

5. The device of claim 4, wherein said surface disposed radially within said first eccentric disc periphery is formed by a bottom of a groove provided in said periphery of said first eccentric disc.

6. The device of claim 4, wherein said contact surface provided radially within said periphery of said first eccentric disc is formed by a rib disposed on a side of said first eccentric disc.

7. The device of claim 1, wherein said spring element comprises a cylindrical helical spring mounted to said base plate at each of its ends, whose periphery abuts tangentially on said first eccentric disc.

8. The device of claim 7, wherein said helical spring abuts under pressure on said first eccentric disc.

9. The device of claim 1, wherein said first spring element comprises a leaf spring which abuts the first eccentric disc.

10. The device of claim 1, wherein said first spring element comprises a spring wire.

11. The device of claim 1, wherein said first spring element is mounted in said base plate for replacement thereof.

12. The device of claim 1, wherein said first spring element is pretensioned at said first radial separations.

13. The device of claim 1, wherein said base plate is molded from plastic or light metal.

14. The device of claim 13, further comprising a first stop cooperating with said first processing rod, said first stop being one of formed and injection-molded on said base plate.

15. The device of claim 13, further comprising a first mounting means for said first spring element, said first mounting means molded to said base plate.

16. The device of claim 1, wherein said base plate has openings for handling the device.

17. The device of claim 1, wherein said base plate defines openings which serve as pivot bearings for said first and said second processing rods.

18. The device of claim 1, further comprising at least one recess in said base plate for mounting the device to a support.

19. The device of claim 18, wherein a dovetailed recess is provided in said base plate to be pushed onto a retaining part of the support.

20. The device of claim 1, wherein one end of each processing rod is guided through a radial opening and into a respective hub, rotatably disposed in said base plate of the device.

21. A device for processing the blade of a knife, the device comprising:

a base plate having a slit dimensioned for guiding the blade, said slit having an opening proximate an outer portion of said base plate for introduction of the blade;

a first processing rod having first a pivot axis cooperating with said base plate at a first side of said slit;

a second processing rod having a second pivot axis cooperating with said base plate at a second side of said slit opposite said first side;

a first hub cooperating with said first pivot axis;

a second hub cooperating with said second pivot axis;

a first elastically resilient arm mounted to said first hub and radially projecting therefrom;

a second elastically resilient arm mounted to said second hub and radially projecting therefrom;

a first stop mounted to said base plate and cooperating with a free end of said first arm; and a second stop mounted to said base plate and cooperating with a free end of said second arm, wherein said first and said second processing rods are loaded by elastic resilient forces of said first and second resilient arms to urge said rods towards said slit opening, said first and second processing rods intersecting in a region of said slit at a point of intersection to which the blade can be applied.

22. The device of claim 21, wherein said first arm is made of plastic material, integral with said first hub.

23. The device of claim 21, wherein said first arm element is mounted in said base plate for replacement thereof.

24. The device of claim 21, wherein said first arm is pretensioned when said point of in intersection first accepts the blade.

25. The device of claim 21, wherein said base plate is molded from plastic or light metal.

26. The device of claim 25, further comprising a first stop cooperating with said first processing rod, said first stop being one of formed and injection-molded on said base plate.

27. The device of claim 1, wherein one end of said first processing rod is guided into and through a radial opening in said first hub.

* * * * *